US007450894B2

(12) United States Patent
Matsumoto

(10) Patent No.: US 7,450,894 B2
(45) Date of Patent: Nov. 11, 2008

(54) IMAGE FORMING APPARATUS

(75) Inventor: Yasuhiro Matsumoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 11/354,638

(22) Filed: Feb. 15, 2006

(65) Prior Publication Data

US 2006/0188299 A1 Aug. 24, 2006

(30) Foreign Application Priority Data

Feb. 22, 2005 (JP) ..... 2005-045451

(51) Int. Cl.
*G03G 15/01* (2006.01)

(52) U.S. Cl. ..... 399/302; 399/303; 399/306; 399/308

(58) Field of Classification Search ..... 399/302–303, 399/298–300, 306, 308
See application file for complete search history.

(56) References Cited

U.S. PATENT DOCUMENTS 6,999,196 B2 * 2/2006 Ishida ..... 358/1.4
7,162,192 B2 * 1/2007 Yamada et al. ..... 399/302

FOREIGN PATENT DOCUMENTS

| | | |
|---|---|---|
| JP | 2002-99127 | 4/2002 |
| JP | 2002-108039 | 4/2002 |
| JP | 2002-148893 | 5/2002 |
| JP | 2005-266419 | 9/2005 |

* cited by examiner

*Primary Examiner*—David M Gray
*Assistant Examiner*—Geoffrey T Evans
(74) *Attorney, Agent, or Firm*—Canon USA Inc IP. Div

(57) ABSTRACT

An image forming apparatus includes first and second toner image forming sections and a transfer unit. The first and second toner image forming sections include first and second image carriers and first and second intermediate transfer members, respectively. The color toner images are formed on the image carrier and then transferred onto the intermediate transfer member to form a composite color toner image on the intermediate transfer member. In a first mode, the first and second toner image forming sections form both the composite dark and light color toner images on the recording material. In a second mode, the second intermediate transfer member is moved out of contact with the transfer unit and the second image carrier and the second intermediate transfer member are not operated, so that only the first toner image forming section forms the composite dark color toner image on the recording material.

2 Claims, 8 Drawing Sheets

IMAGE FORMING APPARATUS

BACKGROUND OF THE INVENTION

1. Field of the Invention

The present invention relates to an image forming apparatus that uses ordinary color toners of yellow, cyan, magenta, and black as well as additional color toners, such as light cyan and light magenta toners, to form a composite color toner image on an intermediate transfer member.

More particularly, the present invention relates to an image forming apparatus that can increase the life of image carriers.

2. Description of the Related Art

Japanese Patent Application Laid-open No. 2002-148893 discusses a conventional image forming apparatus including a plurality of image carriers arrayed along a moving direction of an intermediate transfer member. Yellow, magenta, cyan, black, light cyan, and light magenta toner images are formed on the image carriers respectively.

Such conventional image forming apparatus drives the image carriers of yellow, magenta, cyan, and black toners when an ordinary image is formed (hereinafter, referred to as an "ordinary image formation mode"), while the image carriers of light cyan and light magenta toners are stopped. Stopping the image carriers of light cyan and light magenta during the ordinary image formation mode is effective to prevent the image carriers of light cyan and light magenta toners from being worn out. Thus, the life of the image carriers can be extended.

However, according to the above-described conventional image forming apparatus, while the image carriers of light cyan and light magenta toners are stopped during the ordinary image formation mode, the image carriers of light cyan toner and light magenta toner have to be disengaged or separated from the intermediate transfer member which contacts the image carriers of light cyan toner and light magenta toner at two portions. Thus, the configuration of the conventional image forming apparatus is complicated.

SUMMARY OF THE INVENTION

The present invention is directed to an image forming apparatus that uses ordinary color toners of yellow, cyan, magenta, and black as well as additional color toners, such as light cyan and light magenta toners, to form a composite color toner image on an intermediate transfer member, characterized in that the apparatus arrangement is simple and the lifespan of the image carriers used for forming light color toner images can be extended.

An aspect of the present invention provides an image forming apparatus including a first toner image forming section, a second toner image forming section, and a transfer unit. The first toner image forming section includes a first image carrier and a first intermediate transfer member. Dark color toner images are formed on the first image carrier and then transferred onto the first intermediate transfer member to form a composite dark color toner image on the first intermediate transfer member.

The second toner image forming section includes a second image carrier and a second intermediate transfer member. Light color toner images are formed on the second image carrier and then transferred onto the second intermediate transfer member to form a composite light color toner image on the second intermediate transfer member. Each light color toner image is substantially less dark as compared with a dark color toner image belonging to the same color phase. The transfer unit is configured to contact with the first intermediate transfer member and to selectively contact with the second intermediate transfer member to transfer the toner images from the first and second intermediate transfer members to a recording material.

The image forming apparatus has first and second modes of operation. In the first mode, the first and second toner image forming sections form the composite dark color toner image and the composite light color toner image on the recording material. In the second mode, the transfer unit and the second intermediate transfer member are moved out of contact with each other, the second image carrier and the second intermediate transfer member do not operate, and the first toner image forming section forms the composite dark color toner image on the recording material.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

Each embodiment of the present invention includes an intermediate transfer belt 7*a* on which a composite dark toner image is formed (referred to as a first intermediate transfer member) and another intermediate transfer belt 7*a* on which a composite light toner image is formed (referred to as a second intermediate transfer member). In the ordinary image formation mode, the second intermediate transfer member is separated from a transfer unit.

When the ordinary image formation mode is selected to form an ordinary color image, photosensitive drums 1 (i.e., image carriers) of light color toners can be disengaged or separated from transfer units 10*a*, 10*b*, 10*c*, and 10*d* at a portion where the light toner image is transferred from the second intermediate transfer member to a recording member. Thus, the image carriers of light color toners can be surely stopped and prevented from being worn out.

First Embodiment

Figure 1:
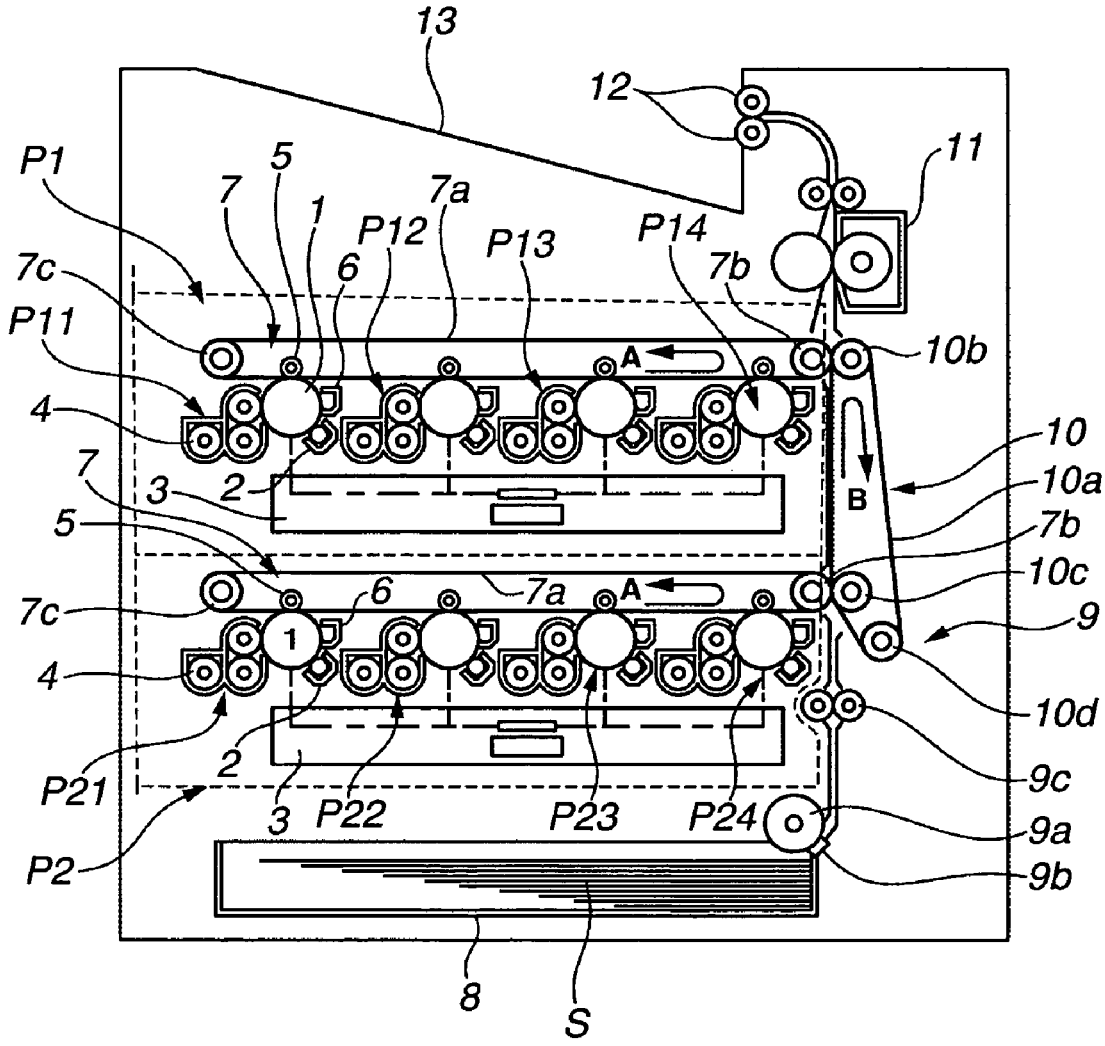
FIG. 1 is a cross-sectional view showing an image forming apparatus operating in a first mode according to a first embodiment of the present invention.
Figure 2:
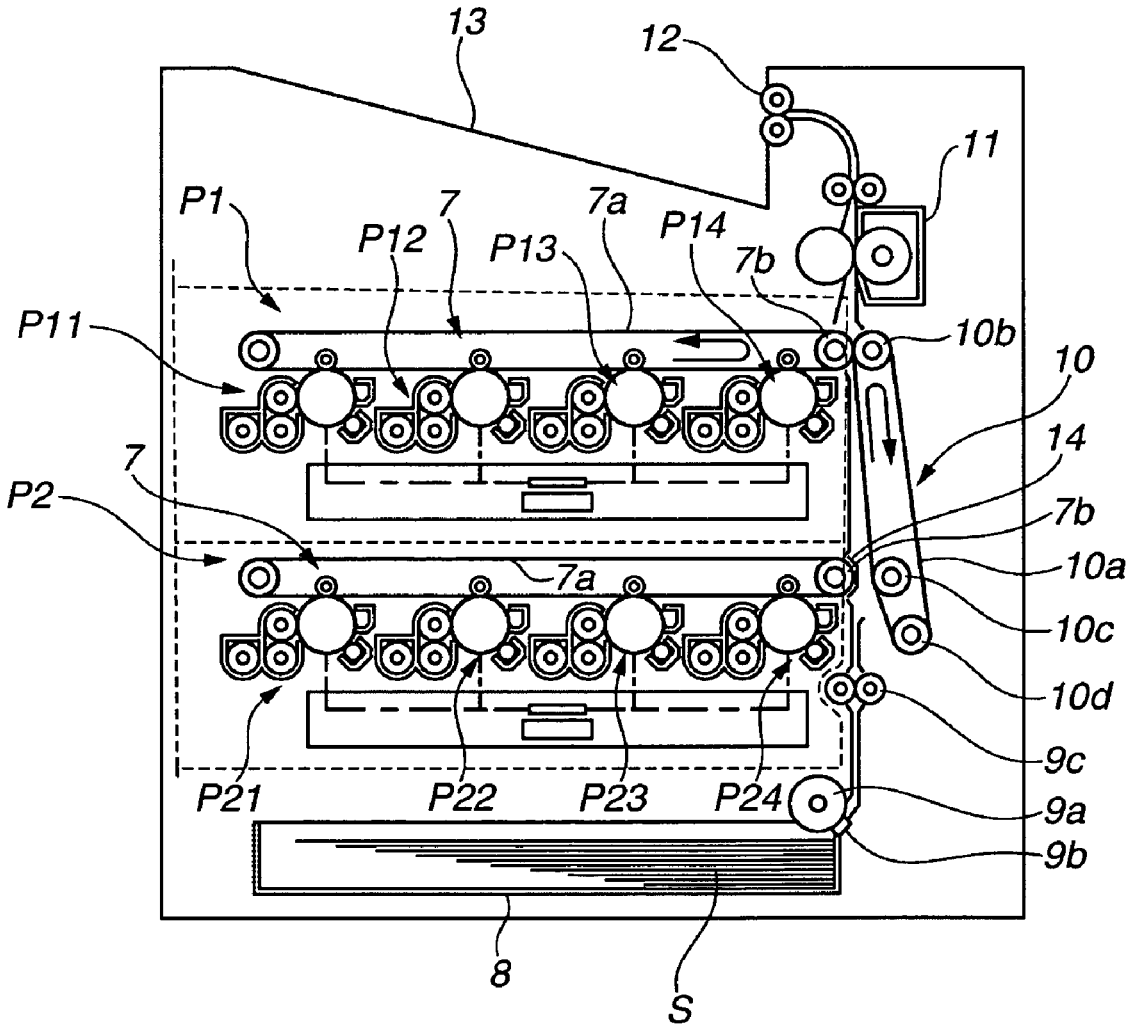
FIG. 2 is a cross-sectional view showing an image forming apparatus operating in a second mode according to the first embodiment of the present invention.

FIGS. 1 and 2 are cross-sectional views showing an image forming apparatus according to a first embodiment of the present invention.

<Arrangement of the Apparatus>

As shown in FIG. 1, the image forming apparatus of the present embodiment includes a sheet cassette 8 that accommodates or stores stacked sheets S. The sheet cassette 8 is located at a lower part of the apparatus body. Each sheet S is conveyed along a predetermined path (i.e., a sheet conveyor path) extending upward in the apparatus body. The image forming apparatus includes an image forming section provided along the sheet conveyor path. When the sheet S passes the image forming section, an image of color toners is formed on the sheet S. The sheet S then passes a fixing section before it is discharged to a sheet discharging section disposed at an upper part of the apparatus body. Using such arrangement is advantageous in reducing an installation space of the image forming apparatus.

The image forming section, as shown in FIG. 1, is substantially divided into a first image forming section P1 and a second image forming section P2. The first image forming section P1 forms a plurality of toner images of predetermined colors. The second image forming section P2 forms a plurality of toner images of predetermined colors different from those of the first image forming section P1. The first image forming section P1 is positioned above the second image forming section P2.

The first image forming section P1 includes a total of four image forming stations P11, P12, P13, and P14 that form toner images (dark toner images) of yellow (dark yellow), magenta (dark magenta), cyan (dark cyan), and black (dark black) colors using an electrophotographic method. The image forming stations P11, P12, P13, and P14 are disposed sequentially in a lateral direction. The image forming stations P11, P12, P13, and P14 are mutually identical in arrangement, although the toner color of each station is different from those of the others. More specifically, each image forming station includes a photosensitive drum 1 functioning as an image carrier. Provided around the photosensitive drum 1 are an charging unit 2, an exposure unit 3, a developing unit 4, a primary transfer charging unit 5, and a drum cleaner 6.

The primary transfer charging unit 5, in each of the image forming stations P11 to P14, is assembled in an intermediate transfer unit 7. The primary transfer charging unit 5 is brought into contact with a reverse surface of the intermediate transfer belt (i.e., intermediate transfer member) 7*a*. In other words, the intermediate transfer belt 7*a* is sandwiched between the primary transfer charging unit 5 and the photosensitive drum 1. The intermediate transfer belt 7*a* is entrained around a secondary transfer counter roller 7*b* and a tension roller 7*c*. The secondary transfer counter roller 7*b* is a driving roller that conveys or moves the intermediate transfer belt 7*a* in a direction of arrow A shown in the drawing.

The first image forming section P1 controls respective photosensitive drums 1 to primarily transfer the toner images of four colors onto the intermediate transfer belt 7*a* in an overlapped or superposed manner. The overlapped or superposed image is then secondarily transferred onto the sheet S conveyed from the sheet cassette 8. Thus, an ordinary full color image is formed on the sheet S.

Furthermore, the second image forming section P2 includes a total of four image forming stations P21, P22, P23, and P24 that form toner images of photo yellow (light yellow), photo magenta (light magenta), photo cyan (light cyan), and photo black (light black) colors using an electrophotographic method. The image forming stations P21, P22, P23, and P24 are disposed sequentially in a lateral direction. The image forming stations P21, P22, P23, and P24 are mutually identical in arrangement, although the toner color of each station is different from those of the others. In this respect, the second image forming section P2 is identical with the first image forming section P1, although the toners of respective image forming stations are different from those of the first image forming section P1.

In the embodiment, yellow toner (dark yellow toner), magenta toner (dark magenta toner), cyan toner (dark cyan toner), and black toner (dark black toner) are collectively referred to as dark color toners. Furthermore, photo yellow toner (light yellow toner), photo magenta toner (light magenta toner), photo cyan toner (light cyan toner), and photo black toner (light black toner) are collectively referred to as light color toners. The dark color toner and the light color toner of the same color phase are mutually differentiated in the degree of darkness. The light color toner is lessened in darkness compared with the dark color toner belonging to the same color phase.

The toners belonging to the same color phase but differentiated in darkness are generally defined as toners that are identical with each other in the spectral characteristics with respect to color developing components (pigments) but are mutually differentiated in the contents of the color developing components (pigments), when each toner is composed of a resin and color developing components (pigments).

The toner lessened in darkness has a relatively lower darkness when compared with other toners belonging to the same color phase but differentiated in darkness.

Furthermore, as described above, the toners belonging to the same color phase have the same spectral characteristics with respect to the color developing components (pigments).

Strictly speaking, even when the toners are not exactly identical with each other in the spectral characteristics with respect to the color developing components, they belong to the same color phase when they can be regarded as the same color in view of the general concept of ordinary colors including magenta, cyan, yellow, and black.

According to the present invention, a light color toner (i.e., a toner lessened in darkness) belonging to the same color phase has an optical density less than 1.0 in an image fixed condition when its toner amount on a recording medium is 0.5 mg/cm$^2$. Meanwhile, a dark color toner (i.e., a toner enhanced in darkness) belonging to the same color phase has an optical density equal to or greater than 1.0 in an image fixed condition when its toner amount on a recording medium is 0.5 mg/cm$^2$.

In the present embodiment, blending the pigments is carried out in such a manner that dark color toners have an optical density of 1.6 in an image fixed condition when their toner amount on a recording medium is 0.5 mg/cm$^2$. On the other hand, light color toners have an optical density of 0.8 in an image fixed condition when their toner amount on a recording medium is 0.5 mg/cm$^2$. Appropriately blending two kinds of (i.e., dark and light) toners can obtain a desired gradation of cyan and magenta colors.

The first image forming section P1 forms toner images of four colors (yellow, magenta, cyan, and black) on the sheet S. The second image forming section P2 forms toner images of high-quality four colors (photo yellow, photo magenta, photo cyan, and photo black) on the sheet S transferred from the first image forming section P1. As a result, a composite color image composed of a total of eight color toner images mutually overlapped or superposed is formed on the sheet S as a high-quality full color image.

A sheet conveyor unit 9 conveys the sheet S from the sheet cassette 8 to the image forming sections P1 and P2. The sheet conveyor unit 9 includes a delivery roller 9*a*, a separating pad 9*b*, and a pair of conveyor rollers 9*c*. The delivery roller 9*a* successively delivers recording sheets out of the sheet cassette 8. The separating pad 9*b*, pressed against the delivery roller 9*a*, has a function of separating only one recording sheet (i.e. uppermost sheet) from others. The paired conveyor rollers 9*c* cooperatively convey the separated recording sheet upward to a secondary transfer section.

A conveyor belt unit 10 includes an endless conveyor belt 10*a*, secondary transfer rollers 10*b* and 10*c*, and a tension roller 10*d*. The endless conveyor belt 10*a* and the secondary transfer rollers 10*b* and 10*c* are opposed to the first image forming section P1 as well as to a secondary transfer counter roller 7*b* constituting part of the secondary transfer section of the second image forming section P2. The conveyor belt 10*a* is entrained around two secondary transfer rollers 10*b* and 10*c* and the tension roller 10*d*.

A recording sheet, when placed between the secondary transfer counter roller 7*b* and the endless conveyor belt 10*a*, is conveyed upward. The secondary transfer roller 10*b* is a driving roller that conveys the endless conveyor belt 10*a* in a direction of arrow B shown in FIG. 1. A fixing unit 11, provided above the secondary transfer section, has a function of fixing the transferred toner images on the sheet S with application of heat and pressure.

A sheet discharging section 13 is provided at an upper part of the apparatus body. The sheet discharging section 13 includes a pair of discharging rollers 12 provided at a downstream side of the fixing unit 11 in the sheet conveyor direction. The paired discharging rollers 12 cooperatively discharge the sheet S out of the apparatus body.

The conveyor belt 10*a*, the secondary transfer rollers 10*b* and 10*c*, and the tension roller 10*d* are united together. The conveyor belt unit 10 can be disengaged or separated away from the secondary transfer section of the second image forming section P2 by a retreating unit (not shown). More specifically, the conveyor belt unit 10 is rotated (or swung) about a rotational axis of the secondary transfer roller 10*b*. The secondary transfer roller 10*b* constitutes a part of a secondary transfer section of the first image forming section P1.

The conveyor belt unit 10 can take two positions relative to the apparatus body. In one position, the conveyor belt 10*a* is brought into contact with the secondary transfer counter roller 7*b* of the second image forming section P2 (refer to FIG. 1). In another position, the conveyor belt 10*a* is positioned away from the secondary transfer counter roller 7*b* (refer to FIG. 2).

The image forming apparatus of the present embodiment has first and second modes of operation. In the first mode, the image forming apparatus forms a high-quality image composed of eight color toner images. The first mode is referred to as a high-quality full color mode. In the second mode, the image forming apparatus forms an ordinary color image composed of four color toner images. The second mode is referred to as an ordinary full color mode.

For example, a user can push a button or touch a switch on an operation panel to select either the first mode or the second mode. The image forming apparatus switches its operation mode according to the preference of the user. When the first mode is selected, the conveyor belt unit 10 is located as shown in FIG. 1. When the second mode is selected, the conveyor belt unit 10 is located as shown in FIG. 2.

The image forming apparatus of the present embodiment includes a sheet guiding member 14 that is selectively engaged with or disengaged from the sheet conveyor path of the intermediate transfer belt 7*a* of the second image forming section P2 in accordance with rotation of the conveyor belt unit 10.

<High-Quality Full Color Mode>

An image forming operation in each mode will be described below. First, an image forming operation according to the high-quality full color mode will be described.

A user selects the first mode when high-quality full color image formation is desired. When the first mode is selected, the image forming stations P11 to P14 of the first image forming section P1 and the image forming stations P21 to P24 of the second image forming section P2 operate in the following manner. First, each charging unit 2 electrifies the surface of the photosensitive drum 1. The exposure unit 3 exposes the charged surface according to an image. Thus, electrostatic latent images of respective colors are formed on the surface of the photosensitive drums 1.

The conveyor unit 9 picks up an uppermost sheet from the sheet cassette 8 and conveys the sheet upward in the vertical direction. First, in the second image forming section P2, high-quality toner images of photo yellow, photo magenta, photo cyan, and photo black primarily transferred onto the intermediate transfer belt 7*a* are secondarily transferred onto the sheet S by applying a transfer bias to the secondary transfer roller 10*c*.

Next, in the first image forming section P1, ordinary full color toner images of yellow, magenta, cyan, and black primarily transferred onto the intermediate transfer belt 7*a* are secondarily transferred onto the sheet S by applying a transfer bias to the secondary transfer roller 10*b*.

As a result, high-quality toner images of eight colors are transferred onto the sheet S. The sheet S is conveyed to the fixing unit 11 wherein the image is fixed. Then, the sheet S is discharged to the sheet discharging section 13.

<Ordinary Full Color Mode>

An image forming operation according to the ordinary full color mode will be described below. A user selects the second mode when ordinary full color image formation is desired. When the second mode is selected, the conveyor belt unit 10 rotates in a counterclockwise direction as shown in FIG. 2 and accordingly the conveyor belt 10*a* departs from the second image forming section P2. In response to the rotation of the conveyor belt unit 10, the sheet guiding member 14 shifts from a retreat position to the recording sheet conveyor path of the intermediate transfer belt 7*a*. Alternatively, the second image forming section can be moved out of contact with the conveyor belt, or both the second image forming section and the conveyor belt are moved out of contact with each other.

Then, in the selected second mode, the control of the photosensitive drums 1 and the intermediate transfer belt 7*a* constituting the second image forming section P2, including roller driving and electric control, is brought into a stand-by condition. Accordingly, all of the members constituting the second image forming section P2 stop their operations.

Accordingly, when the sheet S is picked up from the sheet cassette 8, the paired conveyor rollers 9*c* convey the sheet S upward while the sheet guiding member 14 guides the sheet S toward the first image forming section P1.

During this operation, the sheet guiding member 14 covers the intermediate transfer belt 7*a* of the second image forming section P2. Thus, no friction occurs between the intermediate transfer belt 7*a* and the moving sheet S. Accordingly, durability of the intermediate transfer belt 7*a* (i.e., the second image forming section P2) does not deteriorate.

The first image forming section P1 operates in the same manner as in the first mode. The toner images of yellow, magenta, cyan, and black colors formed on respective photosensitive drums 1 are primarily transferred onto the intermediate transfer belt 7*a*. Then, the toner images are secondarily transferred onto the sheet S conveyed into the first image forming section P1. Thus, an ordinary full color image composed of four colors of yellow, magenta, cyan, and black is recorded on the sheet S. The fixing unit 11 fixes the formed image. Then, the sheet S is discharged to the sheet discharging section 13.

As described above, the first mode enables the image forming apparatus to obtain a high-quality image. Furthermore, the second mode enables the image forming apparatus to form an ordinary full color image while stopping the operation of the second image forming section P2 that is used for forming a high-quality image. Therefore, the durability of the second image forming section P2 can be adequately maintained. In other words, the present embodiment can assure increased lifespan for the image forming apparatus.

Second Embodiment

Figure 3:
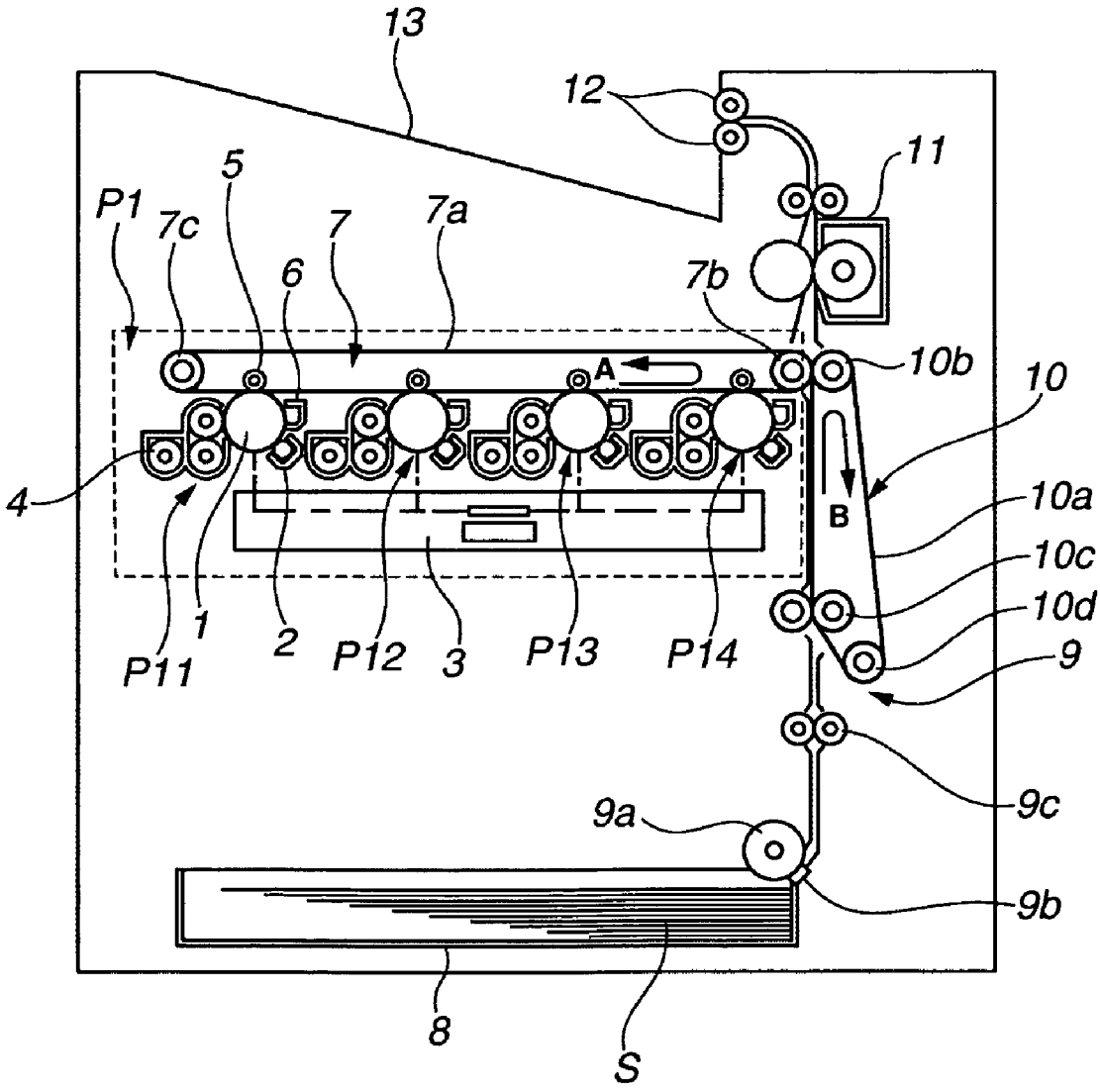
FIG. 3 is a cross-sectional view showing an image forming apparatus according to a second embodiment of the present invention.

An image forming apparatus according to a second embodiment of the present invention will be described below with reference to FIG. 3. The basic apparatus arrangement of the second embodiment is identical with that of the above-described first embodiment. Therefore, only the characteristic arrangement of the second embodiment will be described below. The portions or components identical with those of the first embodiment are denoted by the same reference numerals.

The second embodiment is different from the first embodiment in that the second image forming section P2 is detachably assembled with the body of the image forming apparatus. FIG. 3 shows a condition where the second image forming section P2 is removed from the image forming apparatus.

According to the arrangement of the second embodiment, the second image forming section P2 is installed in the apparatus body when the first mode (i.e., the high-quality full color mode) is selected. Thus, a composite toner image composed of eight colors can be formed in the same manner as in the first embodiment. On the other hand, when the second mode (i.e., the ordinary full color mode) is selected, the second image forming section P2 is removed from the apparatus body as shown in FIG. 3. Thus, only the first image forming section P1 is driven to form an image on a recording sheet.

Furthermore, the image forming apparatus of the present embodiment includes a sensor (not shown in the drawing) that can detect whether or not the second image forming section P2 is installed in the image forming apparatus. A user can select the first mode only when the presence of the second image forming section P2 in the image forming apparatus is confirmed based on a signal of the sensor. In other words, selection of the first mode is prohibited when the second image forming section P2 is removed. Thus, a user is allowed to select the second mode only.

According to the arrangement of the second embodiment, common components and/or the same arrangement can be used for an apparatus capable of performing both an ordinary full color printing and a high-quality full color printing as well as for an apparatus capable of performing only an ordinary full color printing.

Accordingly, the research and development for the image forming apparatus having various functions satisfying each user's intent and preference can be simultaneously done because many constituent parts and components can be commonly used. Accordingly, the cost and investment for the molds and related research and development can be minimized. As a result, the manufacturing cost can be reduced.

Furthermore, even if the initial capability of an apparatus is limited to only performing the ordinary full color printing, a secondary image forming unit can be later added to the apparatus depending on user's intent to use. Thus, the apparatus can easily operate, as an optional function, to satisfy the requirement for high-quality full color printing.

Third Embodiment

Figure 4:
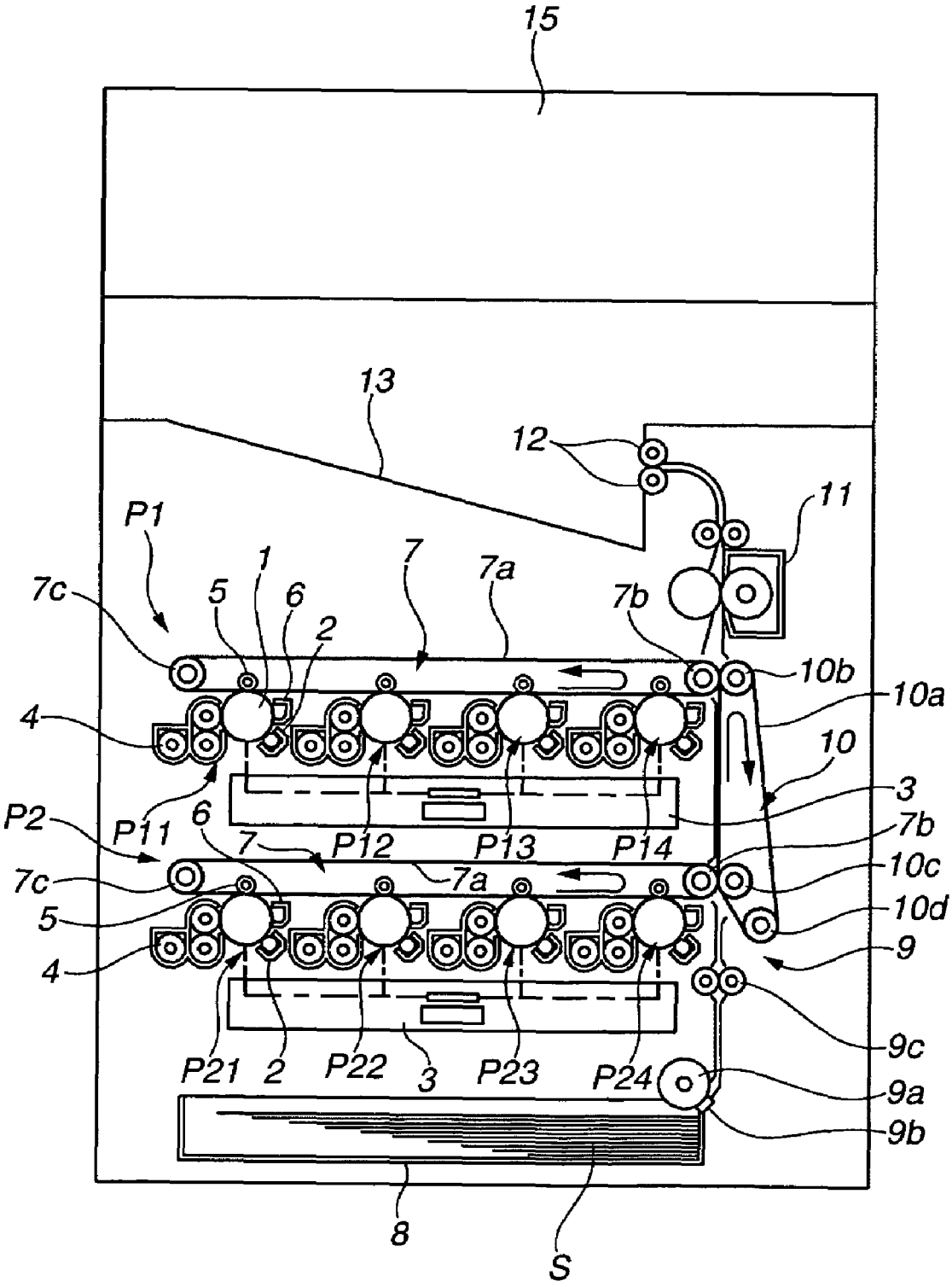
FIG. 4 is a cross-sectional view showing an image forming apparatus according to a third embodiment of the present invention.

An image forming apparatus according to a third embodiment will be described below with reference to FIG. 4.

The basic apparatus arrangement of the third embodiment is identical with that of the above-described first embodiment. Therefore, only the characteristic arrangement of the third embodiment will be described below. The portions or components identical with those of the first embodiment are denoted by the same reference numerals.

The third embodiment is different from the first embodiment in that an image reading section 15 reading an original is provided at an upper part of the apparatus body. The image forming apparatus of the third embodiment includes a first image forming section P1 and a second image forming section P2, each including four photosensitive drums 1. The first image forming section P1 is disposed above the second image forming section P2.

In other words, the image forming apparatus of the third embodiment requires substantially the same installation space (i.e., a 2-dimensional size of the apparatus seen from above) as that of a conventional image forming apparatus having the limited capability of performing an ordinary full color printing with four photosensitive drums. Accordingly, the third embodiment enables to install, to an upper part of the apparatus body, the image reading section 15 that can be commonly used for other ordinary color image forming apparatuses.

Fourth Embodiment

Figure 5:
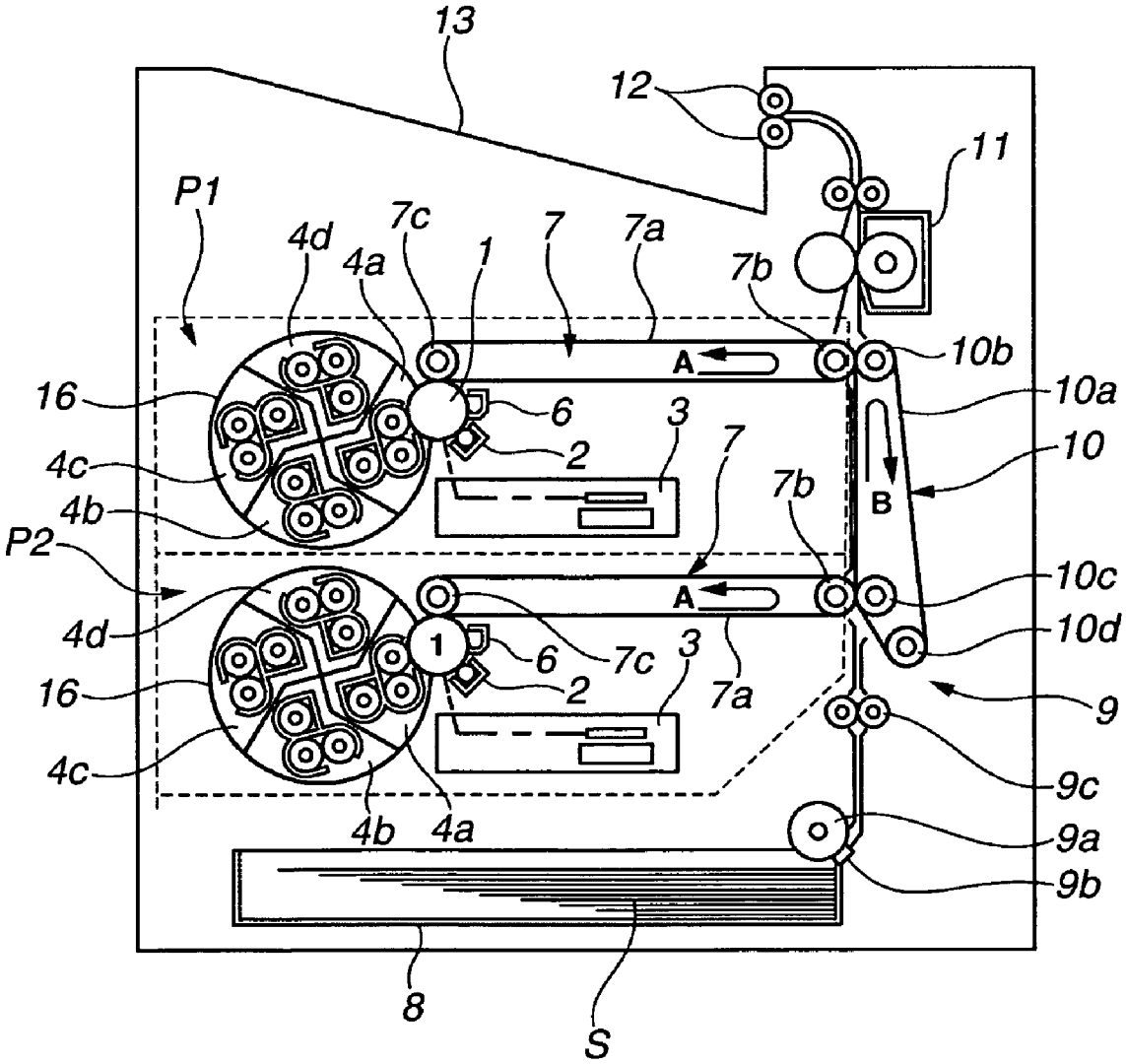
FIG. 5 is a cross-sectional view showing an image forming apparatus according to a fourth embodiment of the present invention.

An image forming apparatus according to a fourth embodiment of the present invention will be described below with reference to FIG. 5.

The basic apparatus arrangement of the fourth embodiment is identical with that of the above-described first embodiment. Therefore, only the characteristic arrangement of the fourth embodiment will be described below. The portions or components identical with those of the first embodiment are denoted by the same reference numerals.

According to the above-described embodiments, each of the first image forming section P1 and the second image forming section P2 includes four photosensitive drums 1 serially disposed in line in the lateral direction to form a plurality of toner images. On the other hand, the image forming apparatus of the fourth embodiment includes image forming sections P1 and P2, each characterized in that a charging unit 2, an exposure unit 3, and a drum cleaner 6 are disposed around one photosensitive drum 1. Furthermore, each of the image forming sections P1 and P2 includes a rotary developing device 16 consisting of a total of four developing units 4*a*, 4*b*, 4*c*, and 4*d* for developing respective color toner images.

According to the arrangement of the fourth embodiment, the above-described color toner images are formed on the same photosensitive drum 1, while the rotary developing device 16 is rotated. The toner images are primarily transferred onto the intermediate transfer belt 7*a* in an overlapped or superposed manner. Then, the images transferred on the intermediate transfer belt 7*a* are secondarily transferred onto the sheet S conveyed into each image forming section.

In this case, similar to the first embodiment, the conveyor belt unit 10 is selectively rotated according to the first mode and the second mode to perform both the high-quality full color printing and the ordinary full color printing.

The fourth embodiment can bring the same effects as those of the first embodiment. In addition, the total number of photosensitive drums 1, charging units 2, and drum cleaners 6 can be reduced. Accordingly, the cost can be reduced.

According to the image forming apparatus of the present embodiment, the conveyor belt 10*a*, the secondary transfer rollers 10*b* and 10*c* can be united together.

Figure 6:
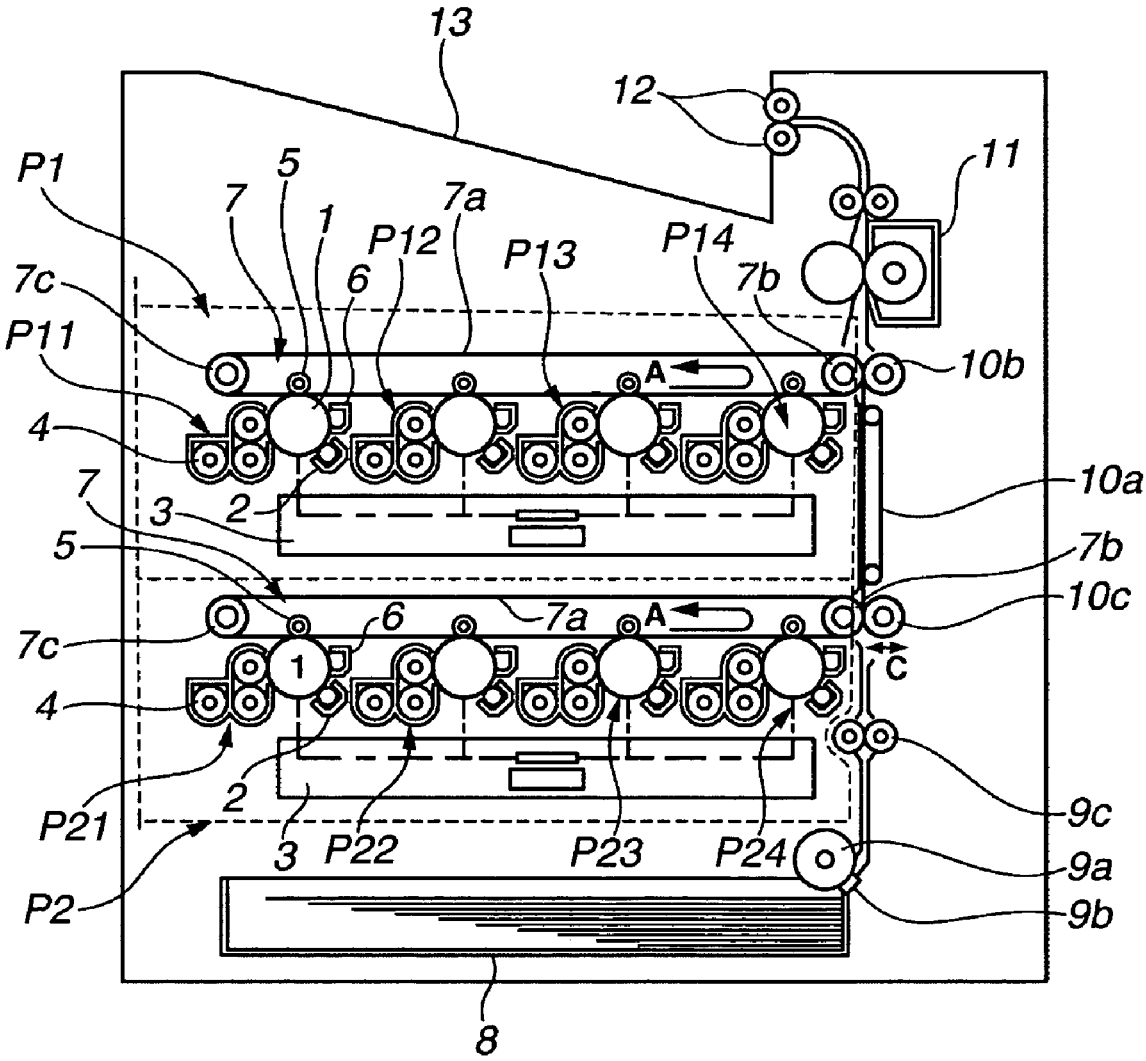
FIG. 6 is a cross-sectional view showing an image forming apparatus operating in the first mode according to a modified embodiment of the first embodiment of the present invention.
Figure 7:
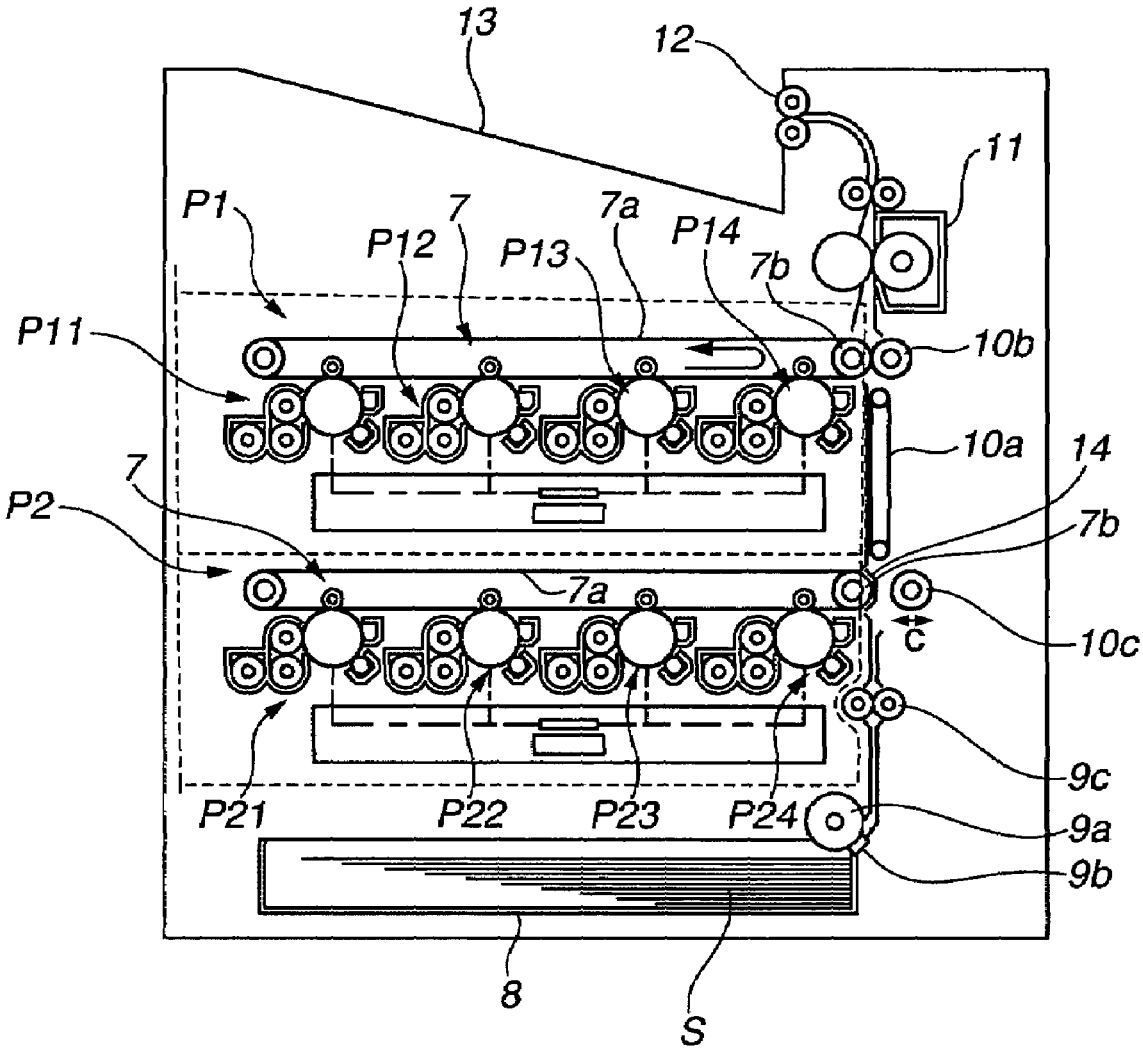
FIG. 7 is a cross-sectional view showing an image forming apparatus operating in the second mode according to a modified embodiment of the first embodiment of the present invention.
Figure 8:
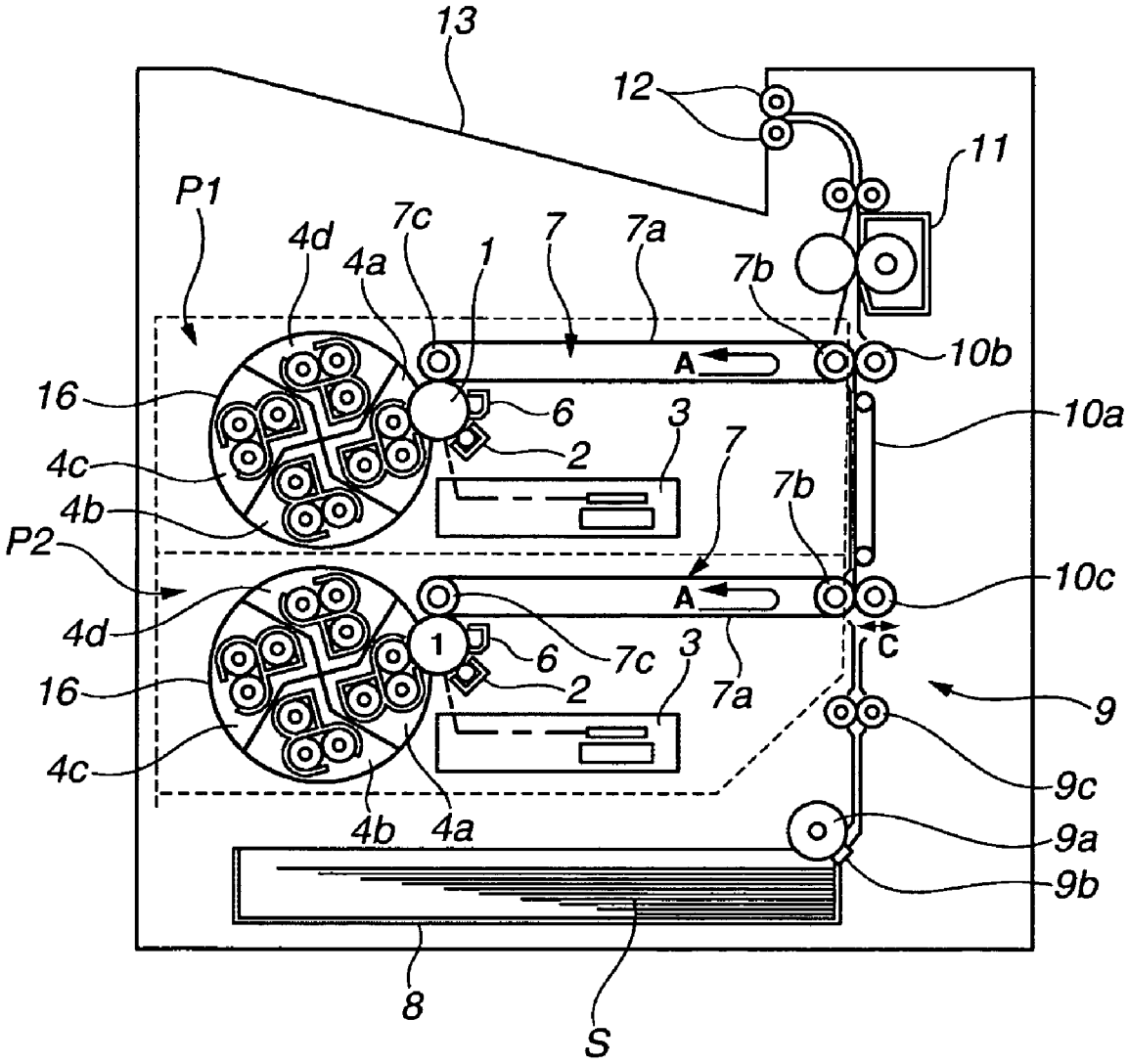
FIG. 8 is a cross-sectional view showing an image forming apparatus according to a modified embodiment of the second embodiment of the present invention.

However, as shown in FIGS. 6 to 8, the conveyor belt 10*a* and the secondary transfer rollers 10*b* and 10*c* can be separately provided. In this case, the secondary transfer roller 10*c* moves in a direction of arrow C when it is separated from the intermediate transfer belt 7*a*. The other secondary transfer roller 10*b* keeps contact with the intermediate transfer belt 7*a*. The conveyor belt 10*a* does not move. When the secondary transfer roller 10*c* is separated (i.e., positioned at a retreat position), no toner images of the second image forming section P2 are transferred from the intermediate transfer belt 7*a* to the sheet.

Moreover, the second image forming section of the image forming apparatus shown in each of FIGS. 1, 4, 5, 6, and 8 forms a composite toner image composed of photo yellow, photo magenta, photo cyan, and photo black colors. However, even if the function of the second image forming section is limited to form a toner image composed of only two (e.g., photo magenta and photo cyan) colors, substantial effects of the present invention can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-045451 filed Feb. 22, 2005, which is hereby incorporated by reference herein in its entirety.

What is claimed is:

1. An image forming apparatus comprising:

a first toner image forming section, including a first image carrier, for forming an image by using toner of deep color on said first image carrier;

a first intermediate transfer member for carrying a toner image transferred from said first image carrier;

a second toner image forming section, including a second image carrier, for forming an image by using toner of light color on said second image carrier, wherein color of said toner of light color is less deep as compared with color of said toner of deep color belonging to the same color phase;

a second intermediate transfer member for carrying a toner image transferred from said second image carrier;

a first transfer member for transferring the toner image on said first intermediate transfer member onto a recording material;

a second transfer member for transferring the toner image on said second intermediate transfer member onto the recording material;

a transfer device including said first transfer member and said second transfer member;

a recording material storing section configured to store the recording material;

a recording material conveyor section configured to convey the recording material substantially in a vertical direction;

a discharging section configured to discharge the recording material carrying the toner image, wherein said recording material storing section, said first intermediate transfer member, the second intermediate transfer member, and the discharging section are disposed sequentially in the vertical direction;

a first image forming mode for forming the image by using toner of deep color and the image by using toner of light color on the recording material while said first intermediate transfer member and said second intermediate transfer member are in contact with said transfer device;

a second image forming mode for forming the image by using toner of deep color on the recording material while the transfer device and the second intermediate transfer member are out of contact with each other and the second image carrier and the second intermediate transfer member do not operate; and a cover member for covering a region where the second intermediate transfer member faces the recording material in the second image forming mode.

2. The image forming apparatus according to claim 1, wherein the transfer device includes:

a belt member contacting the first intermediate transfer member when pressed by the first transfer member and contacting the second intermediate transfer member when pressed by the second transfer member, wherein the transfer device rotates around the first transfer member and is separable from the second intermediate transfer member.

* * * * *